United States Patent [19]

Olsen

[11] 4,421,581

[45] Dec. 20, 1983

[54] SINGLE PLY ROOFING SYSTEM

[76] Inventor: Thomas O. Olsen, P.O. Box 18361, Wichita, Kans. 67218

[21] Appl. No.: 368,120

[22] Filed: Apr. 14, 1982

[51] Int. Cl.[3] ..... E04B 2/00

[52] U.S. Cl. ..... 156/71; 52/746; 427/207.1; 427/208 D; 427/208.8; 427/209; 427/387; 427/407.1; 427/421; 427/389.8; 427/407.3; 427/208

[58] Field of Search ..... 156/71, 329; 427/387, 427/407.1, 207.1, 208.8, 209, 208, 421, 389.8, 407.3; 524/493; 428/266; 52/746

[56] References Cited

U.S. PATENT DOCUMENTS

| | | | |
|---|---|---|---|
| 3,567,493 | 3/1971 | Wessel | 156/329 |
| 3,654,058 | 4/1972 | Jasinski et al. | 156/329 X |
| 3,937,640 | 2/1976 | Tajima et al. | 156/71 |
| 4,029,836 | 6/1977 | Wieczorek | 428/266 X |
| 4,297,265 | 10/1981 | Olsen | 524/493 |

*Primary Examiner*—Thurman K. Page

[57] ABSTRACT

The present invention relates to a roofing system employing a combination of silicone rubber layers. The method utilizes a first layer of silicone rubber which is applied directly to the substrate and is then overlaid by a membrane of silicone rubber impregnated fabric. The fabric layer is placed in position before the first layer cures and is then overcoated with a second layer of silicone rubber which serves as a protective outer coating.

1 Claim, 4 Drawing Figures

SINGLE PLY ROOFING SYSTEM

BACKGROUND OF THE INVENTION

This invention relates generally to roofing systems and, more particularly, to a novel single ply roofing system employing silicone rubber as both the adhesive primer and the protective overcoat.

A silicone rubber coating material having improved surface tension properties is disclosed in my prior U.S. Pat. No. 4,297,265, issued Oct. 27, 1981. As explained in the referenced patent, the silicone rubber composition therein disclosed is useful for application over various surfaces including conventional roofing surfaces. It was heretofore thought that the use of such a silicone rubber coating material for roofing could be carried out in one of two ways. Either a woven cloth membrane would be laid directly over the substrate and the silicone roofing composition applied as an overlayer or the woven fiber membrane would be secured to the substrate by a compatable adhesive and then covered with a suitable layer of silicone roofing composition.

Various silicone rubber coating compositions are disclosed in the prior art. Exemplary compositions are discussed in detail in U.S. Pat. No. 2,751,314, issued June 19, 1956; U.S. Pat. No. 2,934,464, issued Apr. 26, 1960; U.S. Pat. No. 2,979,420, issued Apr. 11, 1961; and U.S. Pat. No. 3,455,762, issued July 15, 1969. Each of the foregoing patents are especially incorporated herein by reference to the extent necessary to obtain a full and complete understanding of the present invention.

SUMMARY OF THE INVENTION

The present invention encompasses a novel roofing system wherein a solution of silicone rubber is utilized as a primer or adhesive coating beneath a woven fabric membrane which is subsequently covered with a second layer of silicone rubber solution. It has been found that the resulting roofing surface exhibits vastly superior properties in terms of weatherability, adhesion and applicability to a wide variety of substrates. The new system has also found surprising adaptation to application in adverse weather conditions. These and other advantages of the system will be discussed in greater detail hereinafter.

OBJECTS OF THE INVENTION

It is, therefore, a primary object of the present invention to provide an improved roofing system wherein a primer of silicone rubber solution is utilized which permits the roof to be applied over surfaces contaminated with dirt or moisture.

Another object of my invention is to provide a roofing system comprising a membrane of woven fabric over-laid with silicone rubber and wherein no adhesive as such is required. Instead a second layer of silicone rubber is used to adhere the woven fabric to the substrate.

It is also an aim of the invention to provide a roofing system which can be completely applied using only conventional spray equipment thus reducing labor costs when compared with conventional roofing systems.

Another objective of this invention is to provide a roofing system which is compatible with a silicone rubber coated woven cloth membrane thereby providing a 100% inorganic system that is more economical than organic roofing systems and not subject to ultraviolet or ozone degradation, rotting, or significant aging.

A further aim of this invention is to provide a silicone base roofing system exhibiting superior water repellent properties as a result of a dual thickness of silicone rubber on either side of a woven rubber impregnated fabric but which exhibits water vapor permeability thereby permitting any moisture trapped beneath the roofing material to escape.

Still another important object of this invention is to provide a roofing system which can be applied at virtually any temperature extreme which is encountered in most parts of the world.

Other objects of the invention will be described or become apparent from the following description and claims when read in light of the accompanying drawing.

DETAILED DESCRIPTION OF THE INVENTION

Figure 1:
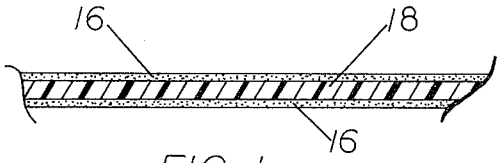
FIG. 1 is a fragmentary, enlarged, vertical cross-sectional view illustrating the roofing system of the present invention.

The manufacture of silicone rubber is discussed in U.S. Pat. No. 2,380,955 which is incorporated into the present application by reference to the extent necessary to obtain a full and complete understanding of the present invention. The term "silicone rubber" is meant to include any polysiloxane which has been cross-linked. Most silicone rubbers are predominately methylpolysiloxane, but the polymer may also contain other organic group substiuents on the polymer chain such as phenyl or vinyl. The most predominately used cross-linking agents for heat cured silicone rubbers are organic peroxides, especially benzoyl peroxide and its derivatives. A number of silicone rubbers are disclosed in U.S. Pat. No. 2,448,756 which is also incorporated herein by reference. A suitable product is dimethylpolysiloxane having a molecular weight of about 500,000.

The silicone rubber employed in the roofing system of the present invention should be a room temperature vulcanizing (RTV) silicone. A characteristic of RTV silicones is that they are cross-linked at room temperature through the addition of a catalyst or by moisture in the air.

For application in the roofing system of the present invention, an RTV silicone is dissolved in a suitable non-reactive solvent with the solid polymer comprising 50–70% by weight of the end solution. Suitable solvents include both aliphatic and aromatic hydrocarbons including heptane, hexane, pentane, naphtha, toluene, xylene, and chlorinated and fluorinated organic and inorganic solvents and silicone base solvents. Aliphatic solvents are preferred and optimum results are obtained with naphtha. The solvent should be free of water and a dessicant may be employed for this purpose.

A quantity of $SiO_2$ is added to the silicone rubber solution in a quantity comprising 90–110% by weight of the silicone rubber solution. The $SiO_2$ preferably has a purity of at least 75% with 95% being preferred. Optimum results are obtained when the $SiO_2$ is at least 99% pure. The $SiO_2$ should also have a particle size of no greater than 45 microns with an average particle size of 9 microns or less being preferred.

Suitable inorganic pigment may be added to the composition in an amount not to exceed 2% by weight (based upon total formulate) if desired.

RTV silicones are classified as either one or two part systems. The one part systems require no mixing by the end user and rely upon moisture vapor from the air to achieve an end cure. One part RTV silicones are preferred for the coating composition used in the roofing system herein described. The one part RTV silicones are commonly classified according to the byproduct which is evolved during the cure. The four most common byproducts are: acidic acid, oxime, alcohol, and acetamide.

Two component RTV silicone systems include a polymer and a catalyst. Moisture is not required to cure a two part RTV system. The two component systems are commonly classified as either condensation or addition based upon the reaction mechanism of the catalyst.

A one part acidic RTV silicone is the preferred material for use in the roofing system of the present invention.

A preferred formulation is:

35% by weight RTV silicone rubber-acetic acid cure, s.g. 1.02–1.08

20% by weight naphtha s.g. 0.75–0.85

50% by weight 99% pure $SiO_2$ s.g. 2.5–2.8 pigmentas desired for coloring is added to the total composition usually in a quantity of 1–2% by weight of the total.

The solid silicone is dissolved in the naphtha with proper mixing and $SiO_2$ and pigment are added gradually while continuing to mix. It is to be understood that the term silicone rubber "solution" as used herein is intended to encompass "suspensions" where some of the silicone along with the $SiO_2$ is not actually in solution in the true sense of the word.

While the silicone rubber solutions herein described may be applied by brushing, doctor blade, or other conventional means, spraying is the preferred application technique.

Figure 3:
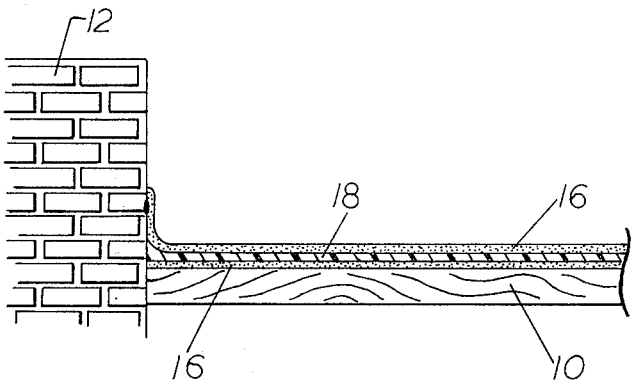
FIG. 3 is another enlarged, vertical cross-sectional view illustrating the manner in which the roofing system of the invention is joined with a parapet wall.

Referring now to FIG. 3 of the drawing, a typical substrate for application of the roofing system of the present invention is designated by the numeral 10 and comprises a wooden base overlaid with conventional asphalt roofing material. While it is preferable to apply the roofing system of the present invention over a clean, dry surface, the system is compatible with moisture and dirt which may contaminate substrate 10.

Figure 2:
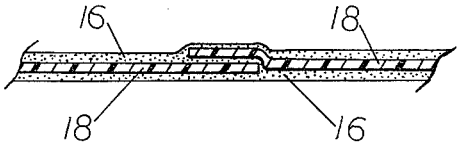
FIG. 2 is another fragmentary, vertical cross-sectional view, on a slightly reduced scale, illustrating the manner in which the seams are formed.
Figure 4:
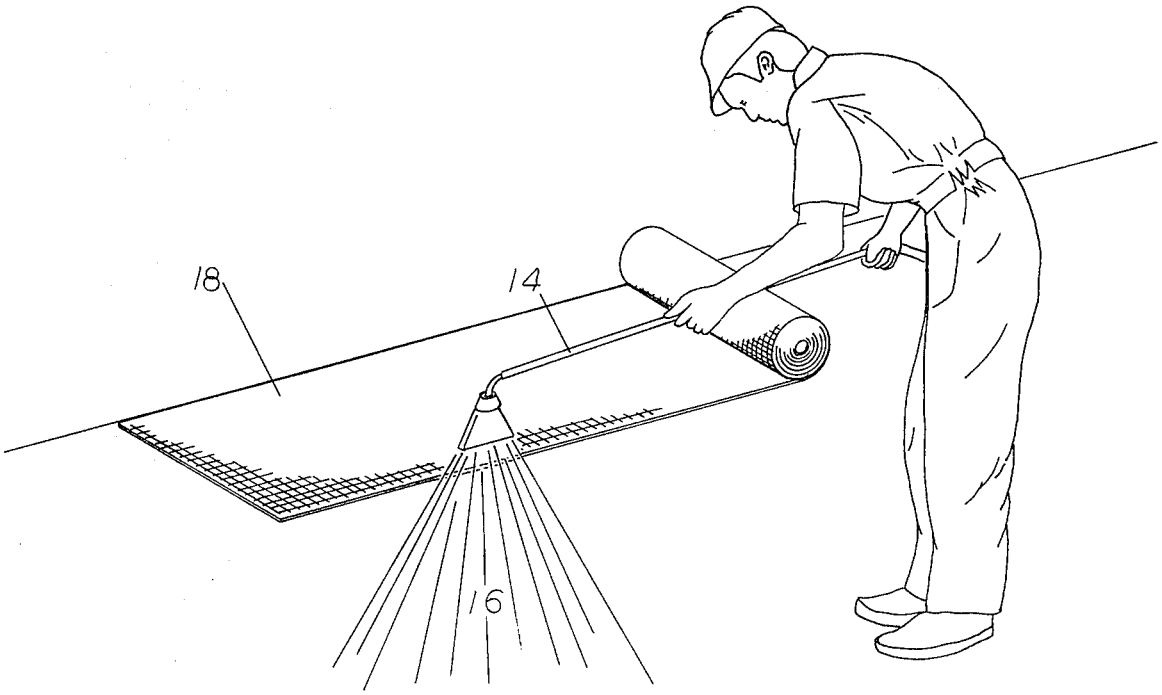
FIG. 4 is a perspective view illustrating the preferred mode of application of the system of the present invention.

Parapet wall 12 is typical of the type of roof construction particularly found on older buildings. The first step in the method of constructing a waterproof roofing covering according to the present invention is to apply a solution of RTV silicone rubber as heretofore described. The silicone rubber is applied by an applicator as shown in FIG. 4 using a spray gun 14. The spray gun is utilized to apply a layer 16 of silicone rubber from 2–20 mils thickness. Next, a roll of woven fabric material 18 is placed over the layer 16 before the latter has an opportunity to cure. Woven fabric 18 is preferably a material constructed of glass cloth and coated with the same RTV silicone solution as used for layer 16. By placing woven fabric layer 18 over silicone rubber 16 before the latter cures, the silicone layer serves as its own adhesive holding the woven fabric in place. The fabric is overlaid in the manner illustrated in FIG. 2, but before this overlaying occurs, a second layer of silicone rubber 16 is sprayed over the woven fabric 18. This eliminates any need for adhesive at the seam between the two overlapping thicknesses of woven fabric. The top layer of silicone rubber is preferably applied at a thickness of 5–15 mils.

Surprisingly, it has been found that a roofing system constructed according to the present invention will offer superior waterproofing properties but will still be vapor permeable so as to allow moisture trapped beneath the roof to escape. Because the system is completely inorganic in nature, it is compatible with limited amounts of water and dirt contaminates, is economical and not subject to rotting, ageing and degradation from sunlight and ozone.

I claim:

1. A method of constructing a waterproof roofing covering over a substrate, said method comprising:

spraying a solution of RTV silicone rubber on said substrate;

laying a membrane of silicone rubber impregnated glass fiber fabric over said silicone rubber layer before the latter has fully cured; and spraying said fabric with a second layer of RTV silicone rubbr solution, said solution of RTV silicone rubber comprising silicone rubber and a solvent therefore with a solids content of 50% to 70% by weight and a quantity of $SiO_2$ comprising 90 to 110% by weight of the combined silicone rubber and solvent, said $SiO_2$ having a particle size of 45 microns or less.

* * * * *